US010597746B2

(12) United States Patent
Bruns et al.

(10) Patent No.: US 10,597,746 B2
(45) Date of Patent: Mar. 24, 2020

(54) HIGH-STRENGTH STEEL HAVING A HIGH MINIMUM YIELD LIMIT AND METHOD FOR PRODUCING A STEEL OF THIS TYPE

(71) Applicants: THYSSENKRUPP STEEL EUROPE AG, Duisburg (DE); thyssenkrupp AG, Essen (DE)

(72) Inventors: Heinz-Werner Bruns, Oberhausen (DE); Alexander Björn Jungermann, Düsseldorf (DE); Andreas Kern, Ratingen (DE); Hans-Joachim Tschersich, Dorsten (DE)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 257 days.

(21) Appl. No.: 15/745,660

(22) PCT Filed: Jul. 24, 2015

(86) PCT No.: PCT/EP2015/067084

§ 371 (c)(1),
(2) Date: Jan. 17, 2018

(87) PCT Pub. No.: WO2017/016582

PCT Pub. Date: Feb. 2, 2017

(65) Prior Publication Data

US 2018/0209008 A1 Jul. 26, 2018

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/04*** | (2006.01) |
| ***C22C 38/02*** | (2006.01) |
| ***C21D 1/18*** | (2006.01) |
| ***C21D 6/00*** | (2006.01) |

(52) U.S. Cl.

CPC ..... *C21D 9/46* (2013.01); *C21D 1/18* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/008* (2013.01)

(58) Field of Classification Search

CPC . C21D 9/46; C21D 1/18; C21D 6/004; C21D 6/005; C21D 6/008; C21D 8/0205; C21D 8/0226; C21D 8/0263; C22C 38/001; C22C 38/002; C22C 38/02; C22C 38/04; C22C 38/06; C22C 38/42; C22C 38/44; C22C 38/46; C22C 38/48; C22C 38/50; C22C 38/54

See application file for complete search history.

(56) References Cited

U.S. PATENT DOCUMENTS

| | | | | |
|---|---|---|---|---|
| 2014/0166163 | A1 | 6/2014 | Jamwal | |
| 2014/0352836 | A1 | 12/2014 | Eguchi et al. | |
| 2015/0354040 | A1* | 12/2015 | Zhao | C21D 1/25 148/506 |

FOREIGN PATENT DOCUMENTS

| | | | |
|---|---|---|---|
| CN | 102534423 | A | 7/2012 |
| CN | 102747303 | A | 10/2012 |
| CN | 103060715 | A | 4/2013 |
| CN | 104011251 | A | 8/2014 |
| EP | 2267177 | A | 12/2010 |
| EP | 2524970 | A1 | 11/2012 |
| EP | 2796587 | A | 10/2014 |
| EP | 2824198 | A | 1/2015 |
| WO | 2014114159 | A | 7/2014 |

OTHER PUBLICATIONS

Bin, Fundamentals of Metal Welding Technology, Jul. 2012, pp. 22-25, National Defense Industry Press, Beijing, China.
Caifu et al., Metallurgy Principle and Application of Vanadium Steel, Jun. 2012, Metallurgical Industry Press, Beijing, China.
Jiuba et al., Superplasticity Application Technology, China Machine Press, Jan. 2005, Beijing, China.

(Continued)

*Primary Examiner* — Anthony J Zimmer
*Assistant Examiner* — Ricardo D Morales
(74) *Attorney, Agent, or Firm* — The Webb Law Firm

(57) ABSTRACT

A high-strength steel having a minimum yield strength of 1300 MPa may include 0.23% to 0.25% by weight carbon, 0.15% to 0.35% by weight silicon, 0.85% to 1.00% by weight manganese, 0.07% to 0.10% by weight aluminium, 0.65% to 0.75% by weight chromium, 0.02% to 0.03% by weight niobium, 0.55% to 0.65% by weight molybdenum, 0.035% to 0.05% by weight vanadium, 1.10% to 1.30% by weight nickel, 0.0020% to 0.0035% by weight boron, and 0.0007% to 0.0030% by weight calcium. The high-strength steel may also include iron, unavoidable impurities, and at least one of the following: at most 0.012% by weight phosphorus, at most 0.003% by weight sulfur, at most 0.10% by weight copper, at most 0.006% by weight nitrogen, at most 0.008% by weight titanium, at most 0.03% by weight tin, at most 2.00 ppm hydrogen, at most 0.01% by weight arsenic, or at most 0.01% by weight cobalt. A method for producing such high-strength steel is also disclosed.

18 Claims, No Drawings

(56) References Cited

OTHER PUBLICATIONS

Lieyu, Isothermal Quenching of Steel and Cast Iron, 1989, Dalian Maritime University Press, Lingshuiqiao, Dalian.
Wanhua et al., Fundamentals of automatic control for Forming Metallic Materials, Textbook for General Higher Education during the Twelfth Five-Year Plan, Aug. 2012, Metallurgical Industry Press, Beijing, China.
Xiangyun et al., Fundamentals of Mechanical Manufacturing, Teaching Materials Recommended by the Ministry of Labor and Social Security for Vocational Skill Appraisal, 2007, Shanghai Jiao Tong University Press.
Xintao et al., Practical Heat Treatment Manual, 2008, Shanghai Science and Technology Press.
DIN EN ISO 6892-1/Method B, Part 1: Method of test at room temperature (ISO 6892-1:2009) English version of DIN EN ISO 6892-1:Dec. 2009, Dec. 2009.
Yoshinori Ito et al., Weldability Formula of High Strength Steels Related to Heat-Affected Zone Cracking, The Sumitomo Search No. 1. May 1969.
DIN EN ISO 643 (May 2013), Steels—Micrographic determination of the apparent grain size (ISO 643:2012); English version EN ISO 643:2012, English translation of DIN EN ISO 643:May 2013, May 2013.
Jis G 0551: 2013, Steels—Micrographic determination of the apparent grain size, (2013).
DIN EN ISO 6506-1, Metallic materials—Brinell hardness test—Part 1: Test method (ISO 6506-1 :2014); English version EN ISO 6506-1 :2014, English translation of DIN EN ISO 6506-1 :Feb. 2015 (Feb. 2015).
DIN EN ISO 148-1, Metallic materials—Charpy pendulum impact test—Part 1: Test method (ISO 148-1 :2009) English translation of DIN EN ISO 148-1 :Jan. 2011 (Jan. 2011).
DIN EN ISO 7438, Metallic materials—Bend test (ISO 7438:2005), English translation of DIN EN ISO 7438:Mar. 2012 (Mar. 2012).
English Translation of International Search Report issued in PCT/EP2015/067084, dated Mar. 17, 2016 (dated Mar. 31, 2016).
DIN EN ISO 6892-1/Method B [[in process of location copy]].
Ito & Bessyo [[in process of locating copy]].
DIN EN ISO 643 (May 2013) [[in process of location copy]].
G 0551 (2005) [[in process of locating copy]].
DIN EN ISO 6506-1. [[in process of locating copy]].
DIN EN ISO 148-1 [[in process of location copy]].
DIN EN ISO 7438 [[in process of location copy]].

* cited by examiner

HIGH-STRENGTH STEEL HAVING A HIGH MINIMUM YIELD LIMIT AND METHOD FOR PRODUCING A STEEL OF THIS TYPE

CROSS REFERENCE TO RELATED APPLICATION

This application is a U.S. National Stage Entry of International Patent Application Serial Number PCT/EP2015/067084, filed Jul. 24, 2015, the entire contents of which are incorporated herein by reference.

FIELD

The present disclosure generally relates to high-strength steels and methods for producing such high-strength steels.

BACKGROUND

In the construction sector, in general mechanical engineering and in electrical engineering, among other sectors, there is a demand for steels or alloys that feature a particular combination of mechanical and corrosion-chemical properties. They are often expected to have, at the same time, a high yield strength, good toughness, high fatigue resistance, high corrosion resistance and high wear resistance.

In crane and mobile crane construction, steels having a minimum yield strength of up to 1100 MPa are currently being used. Continuous further development of the high-strength fine grain construction steels is enabling an evolution in mobile crane construction as a result of the constant increase in load-bearing capacity with simultaneous reduction of service weight. Advances in mobile crane construction technology are increasingly requiring the provision of high-strength steel plate having a minimum yield strength of 1300 MPa.

The prior art discloses hot-rolled steel sheets characterized by good processibility and high tensile strength. Even when the tensile strength exceeds a particular value, for example 1200 MPa, delayed fracture of the steel plate may be caused. Such a fracture can be caused under the influence of a corrosion reaction that occurs in the steel sheet over the course of time, by virtue of hydrogen penetrating into the interior of the steel sheet. Consequently, in spite of its high tensile strength, such a steel sheet has a defect. Steel sheets having a high yield strength up to 1300 MPa accordingly require high resistance to such a delayed fracture.

Steel sheets having a high tensile strength or high minimum yield strength often have the disadvantage that they are processible by cold forming only with difficulty because of their poorer formability. Furthermore, steel sheets having a high tensile strength and high minimum yield strength often have poor toughness properties. Especially at low temperatures of −40° C. or lower, these steels have such low toughness values that use for construction machinery, which has to meet high toughness requirements at low temperatures, is impossible.

EP 2 267 177 A1 discloses a high-strength steel sheet which is used as a structural element in industrial machinery and which firstly has excellent resistance to delayed fracture and secondly has good welding characteristics. The steel sheet of the invention has a high minimum yield strength equal to or higher than 1300 MPa and a tensile strength equal to or higher than 1400 MPa. The thickness of the steel sheet of the invention is equal to or greater than 4.5 mm and less than or equal to 25 mm.

However, the steels which are described in the prior art are not satisfactory in every aspect, and there is a need for steels having improved properties.

Thus a need exists for a high-strength steel having a high minimum yield strength, high tensile strength and, at the same time, good cold forming characteristics and good toughness properties at low temperatures.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

A first aspect of the invention relates to a high-strength steel, wherein the steel comprises the following composition:

(a) carbon: 0.23% to 0.25% by weight;
(b) silicon: 0.15% to 0.35% by weight;
(c) manganese: 0.85% to 1.00% by weight;
(d) aluminum: 0.07% to 0.10% by weight;
(e) chromium: 0.65% to 0.75% by weight;
(f) niobium: 0.02% to 0.03% by weight;
(g) molybdenum: 0.55% to 0.65% by weight;
(h) vanadium: 0.035% to 0.05% by weight;
(i) nickel: 1.10% to 1.30% by weight;
(j) boron: 0.0020% to 0.0035% by weight;
(k) calcium: 0.0007% to 0.0030% by weight;

and wherein the steel optionally comprises further elements, wherein the maximum contents of the further elements are as follows:

(l) phosphorus: ≤0.012% by weight and/or
(m) sulfur: ≤0.003% by weight and/or
(n) copper: ≤0.10% by weight and/or
(o) nitrogen: ≤0.006% by weight and/or
(p) titanium: ≤0.008% by weight and/or
(q) tin: ≤0.03% by weight and/or
(r) hydrogen: ≤2.00 ppm and/or
(s) arsenic: ≤0.01% by weight and/or
(t) cobalt: ≤0.01% by weight;

wherein the remainder comprises iron and unavoidable impurities and wherein (i) the carbon equivalent Pcm can be calculated as $$Pcm=[C]+[Si]/30+[Mn]/20+[Cu]/20+[Ni]/60+[Cr]/20+[Mo]/15+[V]/10+5[B];$$

where [C], [Si], [Mn], [Cu], [Ni], [Cr], [Mo], [V], and [B] are the proportions by mass of the respective elements in the high-strength steel in % by weight and where the following applies to Pcm:

0.38% by weight<Pcm≤0.44% by weight; and/or (ii) the carbon equivalent Ceq can be calculated as $$Ceq=[C]+[Si]/24+[Mn]/6+[Ni]/40+[Cr]/5+[Mo]/4+[V]/14;$$

where [C], [Si], [Mn], [Ni], [Cr], [Mo] and [V] are the proportions by mass of the respective elements in the high-strength steel in % by weight and where the following applies to Ceq:

0.675≤Ceq≤0.78% by weight; and/or (iii) the carbon equivalent CET can be calculated as $$CET=[C]+([Mn]+[Mo])/10+([Cr]+[Cu])/20+[Ni]/40$$

where [C], [Mn], [Cr], [Mo], [Cu] and [Ni] are the proportions by mass of the respective elements in the high-strength steel in % by weight and where the following applies to CET:

0.43% by weight ≤CET ≤0.49% by weight.

Unavoidable impurities in the context of the invention include, for example, arsenic, cobalt and/or tin.

It will be apparent to the person skilled in the art that the steel of the invention may additionally comprise one of the elements (l) to (t). Preferably, the nitrogen content in the steel of the invention may be in the range from 0.001% to 0.006% by weight.

In a preferred embodiment, the steel of the invention comprises carbon in the range from 0.23% to 0.25% by weight, silicon in the range from 0.15% to 0.35% by weight, manganese in the range from 0.85% to 1.00% by weight, aluminum in the range from 0.07% to 0.10% by weight, chromium in the range from 0.65% to 0.75% by weight, niobium in the range from 0.02% to 0.03% by weight, molybdenum in the range from 0.55% to 0.65% by weight, vanadium in the range from 0.035% to 0.05% by weight, nickel in the range from 1.10% to 1.30% by weight, boron in the range from 0.0020% to 0.0035% by weight, calcium in the range from 0.0007% to 0.0030% by weight and nitrogen in the range from 0.001% to 0.006% by weight.

In a preferred embodiment, the sum total of the contents of carbon and of manganese in the high-strength steel is in the range from 1.10% to 1.24% by weight, more preferably in the range from 1.11 to 1.23% by weight, in the range from 1.12 to 1.22% by weight, in the range from 1.13 to 1.21% by weight or in the range from 1.14 to 1.20% by weight.

The high-strength steel of the invention preferably features a high minimum yield strength $R_{eH}$ or $R_{p0.2}$. The minimum yield strength means that stress up to which the steel of the invention, under monoaxial and torque-free tensile stress, does not exhibit any plastic deformation. Preferably, the minimum yield point of the steel of the invention is at least 1300 MPa, more preferably at least 1350 MPa, at least 1370 MPa, at least 1400 MPa, at least 1440 MPa, at least 1480 MPa or at least 1500 MPa. Preferably, the minimum yield strength of the high-strength steel of the invention is determined transverse to rolling direction and determined in accordance with DIN EN ISO 6892-1/Method B.

In addition, the steel of the invention preferably features a high tensile strength $R_m$. The tensile strength refers to the maximum mechanical tensile stress that the steel withstands before fracturing or tearing. Preferably, the tensile strength $R_m$ of the steel of the invention is at least 1400 MPa, more preferably at least 1480 MPa, at least 1500 MPa, at least 1550 MPa, at least 1580 MPa, at least 1600 MPa or at least 1650 MPa. In another preferred embodiment, the tensile stress $R_m$ of the steel of the invention is in the range from 1400 to 1700 MPa. Preferably, the tensile strength of the high-strength steel of the invention is determined transverse to rolling direction and determined in accordance with DIN EN ISO 6892-1/Method B.

In addition, the steel of the invention preferably features a high minimum elongation after fracture A. The minimum elongation after fracture A is a material characteristic which states the remaining extension of the steel after fracture. Preferably, the minimum elongation after fracture A is determined in accordance with DIN EN ISO 6892-1/Method B. Preferably, the minimum elongation after fracture A of the steel of the invention is at least 8%, more preferably at least 9%, at least 10%, at least 11%, at least 12% or at least 13%.

Preferably, the steel of the invention features good toughness properties. A characteristic of toughness properties of material is, for example, the notch impact energy Av. The notch impact energy Av refers to the energy expended until the complete fracture of the material. The notch impact energy Av of the steel of the invention is determined by a Charpy V test according to DIN EN ISO 148-1. If the sample is aligned longitudinally with respect to rolling direction, the notch impact energy Av at a testing temperature of −40° C. is at least 30 J. If the sample is aligned transverse with respect to rolling direction, the notch impact energy Av at a testing temperature of −40° C. is at least 27 J, more preferably at least 30 J, at least 40 J, at least 50 J, at least 60 J or at least 70 J. If the sample is aligned transverse with respect to rolling direction, the notch impact energy Av at a testing temperature of −60° C. is preferably at least 27 J, more preferably at least 30 J, at least 40 J, at least 50 J, at least 60 J or at least 70 J.

The steel of the invention preferably has a martensitic microstructure, preferably consisting of martensite needles having predominantly homogeneously distributed nano-carbide precipitates (Nb, Mo)C or (Nb, Mo)C with traces of vanadium. If the steel of the invention has such nano-carbide precipitates, these preferably have a mean diameter in the range from 1 to 10 nm, more preferably in the range from 2 to 8 nm, in the range from 3 to 8 nm or in the range from 3.0 to 5.0 nm. More preferably, the nano-carbide precipitates have a mean diameter of 4 nm.

It has been found that, surprisingly, the martensitic microstructure established in the steel of the invention, in combination with the predominantly homogeneously distributed nano-carbide precipitates, leads to very good strength and toughness properties with simultaneously good forming properties. What is especially crucial for the establishment of the excellent profile of properties in the steel of the invention is the specific hardening treatment, which is effected in the form of single or multiple hardening operations, followed by brief tempering, in combination with the selection of the chemical composition of the material.

The carbon content of 0.23% to 0.25% by weight is preferably required for hardening of the steel, especially for establishment of a martensitic microstructure with corresponding strength properties. The hardness or strength of the martensite increases with increasing carbon content. In order to achieve the desired strength properties, a carbon content of at least 0.23% by weight is required. The carbon content of the steel is limited to not more than 0.25% by weight, since higher carbon contents would adversely affect the processing characteristics with regard to welding behavior and cold formability.

Silicon is preferably used as a deoxidizing agent in the production of the steel. Secondly, the element preferably contributes to enhancing the strength properties. Furthermore, silicon, alongside carbon, manganese, chromium, molybdenum, nickel and vanadium, is an element that preferably exerts a direct influence on the Ac3 transformation temperature. A transformation temperature refers to a temperature at which the material undergoes a change in phase or to the temperature at which a transformation begins or ends when the transformation proceeds within a temperature range. In the case of steels, the Ac3 temperature is one which is of particular significance. It refers to that temperature at which the conversion of ferrite to austenite ends in a heating operation. Austenite is the name for the face-centered cubic modification of pure iron and the solid solutions thereof. To attain the strength properties required, at least 0.15% by weight of silicon is required for the steel of the invention. If too much silicon is added to the steel, this has an adverse effect on the welding characteristics, forming capacity and toughness properties. The silicon content of the steel of the invention is not more than 0.35% by weight, since preferably even slightly more favorable toughness properties and welding properties can be achieved up to this silicon content.

Manganese is used in fine grain construction steels preferably as an inexpensive alloy element for improving the mechanical and technological material properties. For the steel of the invention, in order to attain the yield strength and material strength levels required, a minimum content of 0.85% by weight of manganese is required. Higher manganese contents of >1.0% by weight can lead to a less favorable martensite structure which can include a coarse plate martensite which has an adverse effect on the toughness properties and cold forming characteristics of the steel. Furthermore, the addition of higher manganese contents increases the carbon equivalent CET, which in turn adversely affects the welding characteristics and forming characteristics of the steel. Moreover, higher manganese contents lead to less favorable segregation characteristics. Segregation refers to separations of a melt which can lead directly to a local increase or else decrease in particular elements within a solid solution. To establish a finely structured martensitic microstructure having good strength and toughness properties, therefore, the upper limit in the manganese content is preferably limited to 1.0% by weight.

An essential distinguishing feature with regard to the chemical composition of the steel of the invention compared to the steel described in EP 2 267 177 A1 is that, for establishment of a martensitic hardening microstructure having good toughness and strength properties, preferably a higher carbon content in the range from 0.23% to 0.25% by weight and a low manganese content in the range from 0.85% to 1.0% by weight have to be established. As already described, for establishment of a purely martensitic microstructure with corresponding strength values, preferably a carbon content in the range from 0.23% to 0.25% by weight in conjunction with a proportionate manganese content is required. In order to prevent the formation of a less favorable and especially highly toughness-reducing microstructure with coarse plate martensite, proportionate manganese contents in the range from 0.85% to 1.0% by weight should preferably be observed in the case of carbon contents in the range from 0.23% to 0.25% by weight. The proportionate combination of the elements manganese and carbon gives rise to an optimized microstructure with very good toughness and strength properties. According to the invention, therefore, the sum total of the contents of carbon and manganese is at least 1.08% by weight and at most 1.25% by weight. To establish a high-strength microstructure having particularly good toughness properties at low temperatures of, for example, −40° C., particular preference is given to compliance with the condition that the sum total of the contents of carbon and manganese is less than or equal to 1.17% by weight.

Phosphorus as a companion of iron has a very significant toughness-reducing effect and, in construction steels and fine grain construction steels, is one of the unwanted accompanying elements. Furthermore, phosphorus can lead to significant segregation on solidification of the melt. The element phosphorus is therefore limited in the steel of the invention to ≤0.012% by weight, preferably to ≤0.010% by weight, more preferably to ≤0.008% by weight, to ≤0.006% by weight or to ≤0.004% by weight.

Sulfur is an unwanted accompanying element which worsens the notched impact resistance and formability or cold forming characteristics. In the case of untreated steels, sulfur takes the form of manganese sulfide inclusions after solidification, which, in the course of rolling to give heavy plate, are stretched parallel to or in the form of lines in rolling direction and have a very unfavorable effect on the material properties, especially on the isotropy of the material (toughness properties transverse to rolling direction). The sulfur content of the steel of the invention is therefore preferably limited to ≤0.003% by weight and is preferably reduced by a controlled calcium treatment. The calcium treatment is additionally preferably utilized for controlled influencing of the sulfide form (spherical form).

Aluminum is used in the steel of the invention in contents in the range of 0.07%-0.10% by weight preferably both as a deoxidizing agent and as a microalloying element. As a deoxidizing agent, it preferably contributes to binding the nitrogen present in the steel, such that the boron, preferably present in contents of 0.0020%-0.0035% by weight, can display its strength-increasing effect. In addition, aluminum is preferably used as a microalloying element for grain refining. Of all the elements which are added to the steel for controlled influence on the austenite grain size, aluminum is the most effective. A fine dispersion of AlN particles preferably effectively inhibits austenite grain growth. In addition, aluminum preferably increases the aging stability of the steel and reduces blowholes and segregation. A blowhole refers to a cavity formed in the course of solidification of castings. The aluminum content is at least 0.07% by weight, in order to establish the desired grain fineness in the steel. Furthermore, this aluminum content has a positive effect on the toughness properties and cold forming characteristics of the steel. The aluminium content is at most 0.1% by weight, since aluminum contents above 0.1% by weight can lead to free aluminum, which increases the risk of formation of unwanted aluminum oxide.

Chromium in contents of 0.65%-0.75% by weight preferably improves the hardenability of the austenite. By virtue of its carbide-forming effect, chromium preferably supports the strength properties of the steel. For this reason, at least 0.65% by weight of chromium is required. Furthermore, addition of the element chromium has a positive effect on the through-hardenability of steels and hence also increases the wear resistance. The addition of higher chromium contents reduces the toughness properties and, as a result of the increase in the carbon equivalent CET, has an adverse effect on welding characteristics. Therefore, according to the invention, the upper limit in the range of chromium contents is limited to 0.75% by weight.

Copper is one of the unwanted accompanying elements. Preferably, the copper content is limited to ≤0.1% by weight.

Niobium in contents of 0.02%-0.03% by weight preferably serves to bind nitrogen. In addition, niobium is preferably present in the steel of the invention to promote austenite grain refining; the niobium carbonitrides finely distributed in the austenite effectively prevent grain growth and thus have a positive effect on the strength and toughness properties of the steel. The niobium content of the steel of the invention is limited to not more than 0.03% by weight, in order to prevent the formation of niobium carbide, which is detrimental to toughness. Niobium is preferably effective in contents over and above 0.02% by weight. Studies on the use of niobium in water-hardened and tempered steels showed that the positive influence of niobium on the mechanical properties can be achieved in contents of 0.02%-0.03% by weight. It is known that niobium in contents of 0.02%-0.03% by weight in water-hardened and tempered steels, by virtue of its grain-refining effect, has a positive influence on strength and toughness properties. Furthermore, niobium in microalloyed boron steels contributes to improving the purity and has a positive effect on toughness properties in the weld seam.

Molybdenum is added to the alloy of the steel of the invention in contents of 0.55%-0.65% by weight, preferably to increase the strength and improve the through-hardenability. For this purpose, a molybdenum content of at least 0.55% by weight is required. Furthermore, molybdenum preferably improves the tempering resistance of the steel and has a positive effect on hot strength and toughness properties. In fine grain construction steels that have been hardened and tempered with water, molybdenum is preferably used in contents of up to 0.7% by weight as a carbide former to increase the yield strength and toughness. Higher molybdenum contents increase the carbon equivalent CET and have an adverse effect on welding characteristics. For optimal welding characteristics, therefore, the molybdenum content of the steel of the invention is limited to not more than 0.65% by weight.

Nitrogen as a companion of iron is detrimental to the mechanical properties of the steels in atomic form. Therefore, the nitrogen content of the steel of the invention for the heat analysis is preferably limited to ≤0.006% by weight. Preferably, the nitrogen content in the steel of the invention is in the range from 0.001 to 0.006% by weight. As a result of the addition of aluminum, the nitrogen present in the melt of the steel of the invention is preferably bound to give sparingly soluble nitrides (AlN).

Preferably, the titanium content in the steel of the invention is limited to ≤0.008% by weight.

Vanadium is added to the steel of the invention in contents of 0.035-0.05% by weight, preferably for grain refining and for increasing the yield strength and material strength levels. Precipitates of vanadium carbonitrides additionally have, as well as the grain-refining effect, also a significant precipitate-hardening effect. Since higher vanadium contents lower the toughness properties, the vanadium content of the steel of the invention is not more than 0.05% by weight.

The addition of nickel in contents of 1.10%-1.30% by weight is preferably required for attainment of the material strength and yield strength levels. In addition, nickel preferably increases the extent to which hardening and tempering operations penetrate the material. Higher nickel contents have only a slight effect on the strength properties of the steel, but these lead to an improvement in the toughness properties. To establish the required toughness values of the steel up to −60° C., therefore, a minimum content of ≥1.10% by weight of nickel is required. Higher nickel contents increase the carbon equivalent CET and have an adverse effect on welding characteristics. Therefore, the nickel content of the steel of the invention is at most 1.30% by weight.

Preferably, boron, a microalloying element, in atomic form delays the microstructural transformation to ferrite and/or bainite and improves the hardenability and strength of fine grain construction steels. However, this mode of action of boron can only be utilized when the nitrogen is stably bound by strong nitride formers. To increase hardenability and strength, a boron content in the range of 0.0020%-0.0035% by weight is added to the alloy in the steel of the invention. The nitrogen is preferably bound by means of the elements aluminum and niobium. The boron content of the steel of the invention is limited to not more than 0.0035% by weight, since the strength-enhancing effect at first increases with rising boron content and drops again above a maximum.

Tin is one of the unwanted accompanying elements. Preferably, the tin content in the steel of the invention is ≤0.03% by weight.

The element hydrogen is reduced, preferably by means of vacuum treatment, preferably to contents of ≤2.0 ppm.

Arsenic is one of the unwanted accompanying elements and the content thereof in the steel of the invention is therefore preferably ≤0.01% by weight.

Calcium is added to the melt preferably as a desulfurizing agent and to influence the sulfide form in a controlled manner, which preferably leads to altered plasticity of the sulfides in heat forming. Furthermore, the addition of calcium preferably also improves the cold forming characteristics of the steel of the invention. The calcium content of the flat steel product of the invention is therefore preferably 0.0007%-0.0030% by weight.

Cobalt is one of the unavoidable accompanying elements from the production process in steel. The content thereof in the steel of the invention is preferably ≤0.01% by weight.

The welding characteristics of a steel can be described with reference to various carbon equivalents. The carbon equivalent in materials science is a measure for assessment of the welding suitability of steels. The carbon content and a multitude of other alloy elements in steel influence the characteristics thereof. To assess welding suitability, therefore, the carbon equivalent summarizes the carbon content and the weighted proportion of the elements that influence the welding suitability of the steel in a similar manner to that which would be expected from carbon in the form of a numerical value. A low value of the carbon equivalent implies good welding suitability. Higher values, depending on the processing thickness, entail the preheating of the material. It is possible to weld the workpiece only with a high level of complexity, since cold cracks and hardening cracks can arise as a result of martensite formation. For the calculation of the carbon equivalent, there is no universal method. One possible carbon equipment is the Pcm according to Ito & Bessyo.

In a preferred embodiment, the steel has an austenite grain size of >11 according to DIN EN ISO 643.

In a preferred embodiment, the carbon equivalent Pcm of the steel of the invention can be calculated as $$Pcm=[C]+[Si]/30+[Mn]/20+[Cu]/20+[Ni]/60+[Cr]/20+[Mo]/15+[V]/10+5[B];$$

where [C], [Si], [Mn], [Cu], [Ni], [Cr], [Mo], [V], and [B] are the proportions by mass of the respective elements in the high-strength steel in % by weight and where the following applies to Pcm:

0.38% by weight<Pcm≤0.44% by weight, more preferably 0.38%<Pcm≤0.41%.

A further carbon equivalent is the Ceq according to Kihara. In a preferred embodiment, Ceq of the high-strength steel can be calculated as $$Ceq=[C]+[Si]/24+[Mn]/6+[Ni]/40+[Cr]/5+[Mo]/4+[V]/14;$$

where [C], [Si], [Mn], [Ni], [Cr], [Mo] and [V] are the proportions by mass of the respective elements in the high-strength steel in % by weight and where the following applies to Ceq:

0.675% by weight≤Ceq≤0.78% by weight, more preferably 0.69% by weight≤Ceq≤0.72% by weight.

The steel of the invention has good weldability. A prerequisite for welding of high-strength fine grain construction steels is that the welded joints are free of cracks. Whether a steel or welded material is sensitive to cold cracking can be judged by the calculation of the carbon equivalent CET. As well as carbon, the elements manganese, chromium, molybdenum, vanadium, copper and nickel favor cold cracking characteristics.

In a preferred embodiment, CET can be calculated as $$CET=[C]+([Mn]+[Mo])/10+([Cr]+[Cu])/20+[Ni]/40$$

where [C], [Mn], [Cr], [Mo], [Cu] and [Ni] are the proportions by mass of the respective elements in the high-strength steel in % by weight and where the following applies to CET:

0.43% by weight≤CET≤0.49% by weight, more preferably 0.44% by weight≤CET≤0.46% by weight.

In the case of more highly alloyed steels, preheating is used as an effective countermeasure to avoid cold cracks, in which case the cooling of the seam region is preferably delayed during and/or after the welding. In a preferred embodiment, the minimum preheating temperature required for the welding of the high-strength steel can be calculated as $$T_P(^\circ\ C.)=700\ CET+160\ \tan h(d/35)+62HD^{0.35}+(53\ CET-32)Q-330,$$

where d is the sheet thickness to be welded in mm, HD is the hydrogen content of the welded material in $cm^3/100$ g and Q is the heat introduced in the course of welding in kJ/mm, and where $T_p$ should be not more than 220° C.

Preferably, by preheating the seam region, it is possible to counteract martensite formation in the seam region, which leads to excessive hardening, in a controlled manner. However, it should be ensured that the maximum preheating temperature stipulated by the steel manufacturer or the tempering temperature of the steel is not exceeded.

Preferably, the steel of the invention is used in the construction sector, in general mechanical engineering and/or in electrical engineering. Particular preference is given to using the steel of the invention in crane and mobile crane construction.

A further aspect of the invention relates to a method of producing a steel product, wherein the method comprises the following steps:

(a) producing a steel melt comprising, as well as iron, the following elements:

carbon: 0.23%-0.25% by weight;
silicon: 0.15%-0.35% by weight;
manganese: 0.85%-1.00% by weight;
aluminum: 0.07%-0.10% by weight;
chromium: 0.65%-0.75% by weight;
niobium: 0.02%-0.03% by weight;
molybdenum: 0.55%-0.65% by weight;
vanadium: 0.035%-0.05% by weight;
nickel: 1.10%-1.30% by weight;
boron: 0.0020%-0.0035% by weight;
calcium: 0.0007%-0.0030% by weight;

and optionally further elements, where the maximum content of the further elements is as follows:

phosphorus: ≤0.012% by weight; and/or
sulfur: ≤0.003% by weight; and/or
copper: ≤0.10% by weight; and/or
nitrogen: ≤0.006% by weight; and/or
titanium: ≤0.008% by weight; and/or
tin: ≤0.03% by weight; and/or
hydrogen: ≤2.00 ppm; and/or
arsenic: ≤0.01% by weight; and/or
cobalt: ≤0.01% by weight (b) reducing the hydrogen content by a vacuum treatment of the steel melt;

(c) casting the steel melt to form a slab;

(d) heating the slab formed to a temperature in the range from 1100° C. to 1250° C.;

(e) descaling the slab;

(f) hot-rolling the slab to give a flat steel product;

(g) optionally coiling the flat steel product, the coiling temperature being at least 800° C.;

wherein the initial rolling temperature in the hot rolling of the slab to give a flat steel product is in the range from 1050° C. to 1250° C. and the final rolling temperature is ≥880° C., and wherein the following applies to the Pcm: 0.38% by weight<Pcm≤0.44% by weight.

All preferred embodiments which have been described above in connection with the high-strength steel of the invention also apply analogously to the method of the invention and will therefore not be repeated.

It will be apparent to a person skilled in the art that the steel melt of the invention may additionally comprise one of the elements phosphorus, sulfur, copper, nitrogen, titanium, tin, hydrogen, arsenic and cobalt. Preferably, the nitrogen content in the steel of the invention is in the range from 0.001% to 0.006% by weight.

In a preferred embodiment, the steel melt of the invention comprises carbon in the range from 0.23% to 0.25% by weight, silicon in the range from 0.15% to 0.35% by weight, manganese in the range from 0.85% to 1.00% by weight, aluminum in the range from 0.07% to 0.10% by weight, chromium in the range from 0.65% to 0.75% by weight, niobium in the range from 0.02% to 0.03% by weight, molybdenum in the range from 0.55% to 0.65% by weight, vanadium in the range from 0.035% to 0.05% by weight, nickel in the range from 1.10% to 1.30% by weight, boron in the range from 0.0020% to 0.0035% by weight, calcium in the range from 0.0007% to 0.0030% by weight and nitrogen in the range from 0.001% to 0.006% by weight.

Preferably, the steel melt is produced in a converter steelworks. In step (b) of the method of the invention, the steel melt is subjected to a vacuum treatment to reduce the hydrogen content preferably to ≤2.00 ppm.

During the production of steel, a microstructure having directed properties can arise on account of the solidification or the rolling. For a rolled base material, behavior dependent on the sample position and test direction then arises in the notched impact bending test. This anisotropy is caused principally by extended manganese sulfides. While their influence is small in the region of the cleavage fracture and the transition temperature is also affected only slightly, a distinct influence is shown in the region of the ductile fracture. An improvement in the isotropy of the toughness properties is obtained by lowering the sulfur content and/or binding the sulfur to give sulfides having higher melting points and correspondingly greater stability to changes in form. Such an influence on the sulfide form can be exerted, for example, by treatment with cerium, titanium or zirconium.

Preferably, the desulfurization and the controlled calcium treatment to influence the sulfide form to reduce the material anisotropy are effected via a calcium treatment of the steel melt having calcium contents in the range from 0.0007% to 0.0030% by weight.

In step (c) of the method of the invention, the steel melt is cast to form a slab in a continuous casting plant. Continuous casting involves solidifying the continuously cast strand via the formation of a solid strand shell, followed by solidification in the direction of the middle of the strand. In the course of this, enrichment of alloy elements may occur at the solidification front. These can cause core segregation in the fully solidified melt. Segregations are separations of a melt which can lead directly to a local increase or else a decrease in particular elements within the solid solution. They arise at the transition of the melt to the solid state. The core segregations can lead to inhomogeneities and nonuniform properties over the cross section of the strand. To positively influence the segregation zone in the slab, preference is given to employing the method of soft reduction. This involves lightly rolling the as yet incompletely solidified strand and hence also the still-liquid core.

In step (d) of the method of the invention, the slab formed in step (c) is preferably heated to a temperature in the range from 1100° C. to 1250° C., more preferably in the range from 1200° C. to 1250° C. Preferably, the heating rate here is in the range from 1 to 4 K/min.

In step (e), the slab is preferably descaled. Preferably, the slab is descaled with a high-pressure slab washer.

Descaling involves removing the scale layer which has formed on the surface of the steel at high temperatures and preferably consists of iron oxides. The descaling can be affected by customary methods known to those skilled in the art, for example by pickling, brushing, jetting, scale removal by bending, or flame cleaning. Preferably, the descaling is effected with water at a pressure in the range from 150 to 300 bar.

In step (f) of the method of the invention, the slab is preferably hot-rolled to give a flat steel product. Preferably, the initial rolling temperature is in the range from 1050° C. to 1200° C. The final rolling temperature is preferably 880° C. and less than 1000° C. Preferably, in each rolling pass, a draft e of 10% is achieved. Preferably, the draft e for each rolling pass is in the range from 10% to 50%. The draft e for each rolling pass is obtained according to the relationship:

$$e=(hE-hA)/hE*100\%$$

where hE is the thickness of the rolling material on entry into the rolling stand, i.e. prior to commencement of the particular rolling pass, in mm and hA is the thickness of the rolling material after emergence from the rolling stand, i.e. after the particular ruling pass, in mm.

Preferably, a total deformation ev of 80% to 98% is achieved. The total deformation ev is determined by the following relationship:

$$ev=(h0-h1)/h0*100\%$$

where h0 is the thickness of the rolling material prior to the commencement of the entire rolling operation, i.e. prior to the first rolling pass, in mm and h1 is the thickness of the rolling material after the entire rolling operation, i.e. after the last rolling pass, in mm.

Preferably, the hot rolling of the slab to give a flat steel product is effected in a reversing manner in a plate rolling mill, preferably having a two-high or four-high rolling stand, and an optional downstream finishing train with several rolling stands, or by means of a hot strip mill consisting of a preliminary rolling stand and a finishing train having up to seven rolling stands.

In a preferred embodiment, the flat steel product of the invention, immediately after the hot rolling, while still hot from the rolling, is subjected to at least one hardening treatment, wherein the hardening treatment comprises rapid quenching of the flat steel product to a temperature below 200° C., wherein the cooling rate is at least 25 K/s. If the flat steel product, immediately after the hot rolling, while still hot from the rolling, is subjected to at least one hardening treatment, the flat steel product is especially subjected to the heat treatment without further heating. In that case, the flat steel product after the hot rolling preferably has a final rolling temperature of at least 860° C.

In another preferred embodiment, the flat steel product after the hot rolling is subjected to at least one hardening treatment, wherein the hardening treatment comprises the following steps:

(i) heating the flat steel product to an austenitization temperature at least 40 K above the Ac3 temperature of the steel of the invention, wherein the Ac3 temperature can be calculated as $$Ac3[°\ C.]=902-255*[C]+19*[Si]-11*[Mn]-5*[Cr]+13*[Mo]-20*[Ni]+55*[V];$$

where [C], [Si], [Mn], [Cr], [Mo], [Ni] and [V] are the proportions by mass of the respective elements in the high-strength steel in % by weight; and (ii) rapidly quenching the flat steel product, such that the cooling rate is at least 25 K/s, to a temperature below 200° C.

The Ac3 temperature indicates the transformation temperature in the heating of the steel at which the transformation of ferrite to austenite ends. The Ac3 can be calculated as an approximation according to Hougardy as:

$$Ac3[°\ C.]=902-255*[C]+19*[Si]-11*[Mn]-5*[Cr]+13*[Mo]-20*[Ni]+55*[V]$$

where [C], [Si], [Mn], [Cr], [Mo], [Ni] and [V] are the proportions by mass of the respective elements in the high-strength steel in % by weight.

Heating of the flat steel product to austenitization temperature for hardening treatment is required especially when the flat steel product cools down after the hot rolling. Preferably, the flat steel product, for hardening treatment, is first heated to an austenitization at least 40 K above the Ac3 temperature of the steel of the invention, in order to achieve complete austenitization of the material. Preferably, the flat steel product, for hardening treatment, is brought to an austenitization temperature in the range from 860° C. to not more than 920° C., more preferably in the range from 870° C. to 920° C.

After the heating, the flat steel product is quenched in a suitable quench medium sufficiently rapidly that at least 70% martensite, preferably 80% martensite, more preferably 90% martensite and most preferably 100% martensite forms. Suitable quench media are, for example, water or oil. The flat steel product of the invention is cooled rapidly, i.e. at a cooling rate of at least 25 K/s, from the austenitization temperature to a temperature of not more than 200° C. Preferably, between 800° C. and 500° C., cooling rates of at least 25 K/s, more preferably at least 50 K/s, at least 100 K/s, at least 150 K/s or at least 200 K/s are required.

In a preferred embodiment, the flat steel product after the hardening treatment, while still hot from the rolling, is subjected to at least one further hardening treatment, wherein the hardening treatment comprises the following steps:

(i) heating the flat steel product to an austenitization temperature at least 40 K above the Ac3 temperature of the steel of the invention, wherein the Ac3 temperature can be calculated as $$Ac3[^\circ C.]=902-255*[C]+19*[Si]-11*[Mn]-5*[Cr]+13*[Mo]-20*[Ni]+55*[V];$$

where [C], [Si], [Mn], [Cr], [Mo], [Ni] and [V] are the proportions by mass of the respective elements in the high-strength steel in % by weight; and (ii) rapidly quenching the flat steel product, such that the cooling rate is at least 25 K/s, to a temperature below 200° C.

A significant difference from the flat steel product known from EP 2 267 177 A1 is that the minimum austenitization temperature of the flat steel product of the invention for homogeneous austenitization is preferably greater than or equal to 860° C. Lower austenitization temperatures of less than 860° C., in combination with the balanced chemical composition of the flat steel product of the invention, preferentially lead to unwanted partial austenitization which is to be prevented. In addition, the austenitization temperature should preferably be ≤920° C., since higher temperatures promote austenite grain growth, which would lead to a reduction in the mechanical and technological properties. Studies have shown that the optimal austenitization temperature for the flat steel product of the invention is preferably about 880° C.

As well as the austenitization temperature, austenite grain growth is preferably also influenced by the austenitization time, although the temperature preferably has a greater influence on austenite grain growth. In a preferred embodiment, the hold time at austenitization temperature for the flat steel product of the invention is not more than 60 minutes, preferably not more than 30 minutes or not more than 15 minutes.

In a preferred embodiment, the hardening treatment of the flat steel product is effected repeatedly, especially two or three times. Preferably, controlled repetition of the hardening operation influences the grain fineness of the flat steel product of the invention in a controlled manner, or preferably improves it by one grain size class according to DIN EN ISO 643. Preferably, a second hardening treatment, through the effect of austenite grain refining, leads to a very fine martensitic microstructure with improved mechanical and technological properties.

In the first hardening treatment, the flat steel product can either be subjected to a hardening treatment while still hot from the rolling, or the flat steel product can first be heated to an austenitization temperature at least 40 K above the Ac3 temperature of the steel of the invention and then subjected to a hardening treatment. In every further hardening treatment, the flat steel product is first heated to an austenitization temperature at least 40 K above the Ac3 temperature of the steel of the invention, and is then subjected to a hardening treatment.

In a preferred embodiment, the flat steel product is tempered after the hardening treatment, wherein the hold time in the tempering treatment is less than 15 minutes and the temperature in the tempering treatment is below the Ac1 temperature, where the Ac1 temperature can be calculated as an approximation according to Hougardy as $$Ac1[^\circ C.]=739-22*[C]+2*[Si]-7*[Mn]+14*[Cr]+13*[Mo]-13*[Ni]+20*[V],$$

where [C], [Si], [Mn], [Cr], [Mo], [Ni] and [V] are the proportions by mass of the respective elements in the high-strength steel in % by weight.

The Ac1 temperature indicates the transformation temperature in the course of heating of the steel at which the formation of austenite commences. In a preferred embodiment, the hold time is at most 10 minutes.

Tempering comprises a heat treatment in which the flat steel product of the invention is heated in a controlled manner in order to influence its properties. Preferably, the tempering of the finely dispersed martensitic microstructure is effected in the temperature range from 150° C. to 300° C., more preferably in the range from 225° C. to 275° C. Preferably, the brief tempering of the finely dispersed martensitic microstructure establishes an optimal combination of strength and toughness, it being necessary to accept a certain reduction in strength in favor of the toughness properties.

Preferably, the flat steel product of the invention is hardened and tempered twice. More preferably, the flat steel product of the invention is hardened and tempered three times.

Preferably, after the first hardening treatment of the flat steel product of the invention, a prior austenite grain size of grain size class 12 according to DIN EN ISO 643 is achieved. The prior austenite grain is understood to mean the austenite grain present prior to the treatment. If the flat steel product of the invention is subjected to a second hardening treatment or double hardening, this preferably has the effect of further halving the grain size, and preferably a prior austenite grain size of grain size class 13 according to DIN EN ISO 643 is established. Grain refining preferably contributes to an improvement in the mechanical and technological properties, especially to an increase in the yield strength level and toughness level. Preferably, the minimum yield strength of the flat steel product of the invention after the hardening treatment is at least 1300 MPa, more preferably at least 1350 MPa, at least 1370 MPa, at least 1400 MPa, at least 1440 MPa, at least 1480 MPa or at least 1500 MPa. Preferably, the tensile strength of the flat steel product of the invention after the hardening treatment is at least 1400 MPa, more preferably at least 1480 MPa, at least 1500 MPa, at least 1550 MPa, at least 1580 MPa, at least 1600 MPa or at least 1650 MPa.

In a preferred embodiment, the flat steel product of the invention, prior to the hardening treatment, has a prior austenite grain size of >11 according to DIN EN ISO 643 (05.2013) or according to G 0551 (2005), which especially leads to a finely dispersed martensitic microstructure having homogeneous strength and toughness properties. Thus, the flat steel product of the invention, compared to the flat steel product known from EP 2 267 177 A1, has a much finer prior austenite grain.

In a preferred embodiment, the flat steel product of the invention is preferably hardened directly after the last rolling pass by means of a suitable water quench device, while still hot from the rolling. This quenches the flat steel product of the invention rapidly, i.e. at a cooling rate of at least 25 K/s, from a final rolling temperature≥880° C. to a temperature of at most 200° C. Preferably, the cooling rate between 800° C. and 500° C. is at least 25 K/s, preferably at least 50 K/s, more preferably at least 100 K/s, at least 150 K/s or at least 200 K/s.

If the hot rolling is effected by means of a hot strip mill, it is possible in step (g) of the method of the invention to coil the flat steel product. Coiling refers to the winding of rolled flat steel products, and a coil is the term for a wound metal strip. In a preferred embodiment, the flat steel product of the invention is coiled, wherein the coiling temperature is at least 800° C.

In another preferred embodiment, the hot strip, while still hot from the rolling, is quenched by means of water to a temperature of ≤200° C.

A further distinguishing feature of the flat steel product of the invention compared to the flat steel product known from EP 2 267 177 A1 is that the invention can be produced in sheet thicknesses of 3.0 mm to 40.0 mm and sheet widths of up to 3900 mm.

In a preferred embodiment, the sheet thickness of the flat steel product is in the range from 3.0 mm to 40.0 mm, more preferably in the range from 4.0 to 15.0 mm.

Preferably, the sheet width of the flat steel product of the invention is ≤3900 mm.

For production of the flat steel product of the invention, preferably, a relatively high carbon content in the range from 0.23% to 0.25% by weight is required, preferably in combination with a tailored analytical profile of the elements chromium, nickel, manganese and molybdenum for establishment of a preferably purely martensitic microstructure having appropriate strength properties up to a sheet thickness of not more than 40.0 mm. A reduction in the carbon content would shift the commencement of bainite formation to shorter cooling times, such that only relatively low sheet thicknesses would consist of a purely martensitic microstructure. Higher sheet thicknesses would have an undesirable mixed microstructure composed of martensite and different bainite contents, which would in turn adversely affect the mechanical and technological properties of the flat steel product of the invention.

The invention is described hereinafter with reference to working examples.

In systematic laboratory and operational trials, a total of six steel melts were produced, the chemical compositions of which are specified in table 1. In addition, the carbon equivalents CET, Pcm and Ceq were calculated for the melts. The steel melts A, B, C, D and E were produced in the laboratory; steel melt F was tested in the works. Steel melts A, B, C and D are melts which were included as comparative examples. Only melts E and F relate to the flat steel product of the invention. All steel melts were cast to slabs which were then heated at a heating rate of 4 K/min to a slab temperature according to table 2, descaled with water at a pressure of 200 bar prior to rolling and then rolled out with a draft e of 10%-50% and a total deformation ev between 81% and 98% to give flat steel products. After the rolling, the flat steel products were cooled at rest under air or at rest in a stack. For heat treatment, the flat steel products were heated to an austenitization temperature according to table 3, kept at this temperature for 15 min, then quenched from the austenitization temperature with water to a cooling stop temperature. Some flat steel products were then heated to a tempering temperature according to table 5, kept at the tempering temperature for 10 min and then cooled under air. Other flat steel products after the first hardening treatment were heated again to an austenitization temperature according to table 4, kept at this austenitization temperature for 15 min, then quenched from the austenitization temperature with water to a cooling stop temperature of less than 200° C. and subjected to a tempering treatment at temperatures according to table 5 and with a respective hold time of 10 min and subsequently air cooling. Some of the doubly hardened flat steel products, prior to the tempering, were subjected to a third heat treatment according to table 5 and an austenitization period of 15 min in each case. The tempering of the triply hardened flat steel products was conducted at temperatures according to table 5 and hold times of 10 min in each case the subsequently air cooling. Each of the flat steel products produced from steels A to F was given a corresponding sample number. The rolling and heat treatment parameters for the hardening and tempering treatment of the flat steel products produced can be found in tables 2 to 5.

The mechanical properties from the tensile test and notched impact bending test, and also the surface hardness and prior austenite grain size, for the flat steel products produced can be found in table 6. The austenite grain size reported in table 6 is the prior austenite grain size.

The determination of the prior austenite grain size is effected according to DIN EN ISO 643 on longitudinal sections which have been taken from the flat steel products in the singly to triply hardened state. The etching was conducted by the method of Béchet-Beaujard with concentrated picric acid.

The tensile tests to determine the yield strength Rp0.2, tensile strength $R_m$ and elongation at break A were conducted according to DIN EN ISO 6892-1 on transverse samples. The notched impact bending tests to determine the notch impact energy Av at test temperatures of −20° C., −40° C. and −60° C. were conducted according to DIN EN ISO 148-1 on transverse samples. Where hardness values are reported, these are the Brinell hardness. The hardness is measured about 1 mm below the sheet surface and is determined according to DIN EN ISO 6506-1.

Table 7 shows, for each flat steel product made from steels A, B, C, D, E and F, the heat treatment state, the microstructure, a final assessment and an assessment of the cold forming characteristics.

The study of microstructure was effected by means of light microscopy and scanning electron microscopy on longitudinal sections which were taken from the flat steel products and etched with Nital. Field emission transmission electron microscopy (FE-TEM) was used to determine both the microstructural state and the precipitation state. As well as conventional bright-field imaging, the bright-field STEM mode (STEM, scanning transmission electron microscopy) and the dark-field STEM mode were employed. The cold forming characteristics were tested by bending tests according to DIN EN ISO 7438 with the bending line at right angles and parallel to rolling direction, with a bending angle of ≥90°.

As already described, melts A to D were produced in the laboratory and included as comparative examples. Compared to the analysis of the flat steel product of the invention (steel melts E and F), these melts have a lower carbon content which leads to a lower yield strength and tensile strength level. The strength properties required for the flat steel product of the invention are not fulfilled by the steel melts of the comparative examples.

Steel melt E which was tested in the laboratory has a higher carbon content compared to the comparative examples, such that the required yield strength and tensile strength level is attained for the flat steel product of the invention with simultaneously adequate toughness.

On the basis of these findings, an operational melt F was produced for the flat steel product of the invention. The mechanical and technological properties of the operational melt F were determined after 1× hardening and tempering (samples F1 to F11), after 2× hardening and tempering (samples F12 to F37) and after 3× hardening and tempering (samples 38 to F50) for the austenitization temperatures of 880° C. or 920° C., and can be found in tables 6 and 7. For the 1× hardening variants at austenitization temperatures of 880° C. (samples F7 to F11) or 920° C. (samples F1 to F6) and for the 2× hardening variant at an austenitization temperature of 920° C. (sample F12), after the tempering, a satisfactory yield strength and tensile strength level was attained with good toughness. The cold forming characteristics of these variants can be described as satisfactory overall. The variants mentioned have an austenite grain size of grain size class G~12 according to DIN EN ISO 643. In addition, in the case of these variants, it was possible to detect relatively coarse martensite plates with relatively coarse precipitates of (Nb, Mo)C or (Nb, Mo)C with traces of vanadium. The majority of the precipitates have a mean diameter of about 8 nm. Residual austenite was not detected, but some acicular cementite ($Fe_3C$) was present. Cementite and coarse precipitates deprive the microstructure of carbon components and make the martensite therein softer. Therefore, these variants have a lower strength level compared to the 2× hardening method at an austenitization temperature of 880° C. and tempering (samples F13 to F37).

A comparison of sample F4 with sample F12 or a comparison of samples F7 to F11 with samples F13 to F37 shows that, in the case of samples with otherwise identical conditions, the yield strength, tensile strength and notch impact energy for the variants with double hardening and tempering are improved compared to single hardening and tempering. A comparison of samples F13 to F37 with samples F38 to F50 shows that the yield strength and tensile strength are increased once again for the samples with triple hardening and tempering (F38 to F50), as a result of a further decrease in the prior austenite grain size, compared to the samples with double hardening and tempering (F13 to F3).

A comparison of samples F1 to F6 with samples F7 to F11 or a comparison of sample F12 with sample F35 shows that, under otherwise identical conditions, the mechanical properties of yield strength, tensile strength and toughness are improved for the variants with a relatively low austenitization temperature of 880° C. compared to an elevated austenitization temperature of 920° C. Particularly good results and an improvement in the cold forming characteristics were achievable in the case of samples which had been either doubly or triply hardened and austenitized at lower temperatures of 880° C. for the hardening process (samples F13 to F37). Studies showed that the prior austenite grain size of the flat steel product of the invention can be improved by up to one grain size class, from G~12 to G~13 according to DIN EN ISO 643, by the method of 2× hardening at an austenitization temperature of 880° C. in each case and tempering (samples F13 to F37). The heat treatment method mentioned leads, in combination with an austenitization temperature of 880° C., in the case of the flat steel product of the invention, to the formation of very fine martensite needle aggregates with ultrafine nano-carbide precipitates. With the aid of STEM dark-field representation, it was possible to show that the flat steel product of the invention, after the method of 2× hardening at an austenitization temperature of 880° C. and tempering, contains very homogeneously distributed nano-carbide precipitates (Nb, Mo)C or (Nb, Mo)C with traces of vanadium. The majority of the nano-carbide precipitates have a mean diameter of 4 nm. Residual austenite was not detected. Nor was any acicular cementite ($Fe_3C$) present.

The specific matrix of the martensitic microstructure, consisting of very fine martensite needle aggregates, in combination with the very finely and homogeneously distributed nano-carbide precipitates, in the flat steel product of the invention, leads to a noticeable increase in the yield strength and material strength levels with simultaneously good cold formability.

In the case of choice of the method of 2× hardening (austenitization temperature of 880° C.) and tempering, compared to the variant of 1× hardening (austenitization temperature of 880° C.) and tempering, with a stable and good level of toughness, the yield strength and material strength level of the flat steel product of the invention is around 60 MPa higher. By triple hardening at an austenitization temperature of 880° C. and tempering, compared to the variant of 2× hardening at an austenitization temperature of 880° C. and tempering, it is possible to increase the yield strength level of the flat steel product of the invention once again by around 60 MPa, again with the stable level of tensile strength and toughness. By the specific method of 3× hardening at an austenitization temperature of 880° C. and tempering, it is even possible to reliably establish minimum yield strengths that are preferably more than at least 1400 MPa, more preferably more than at least 1440 MPa.

TABLE 1

| | Chemical composition [% by weight*] | | | | | | | | | | | |
|---|---|---|---|---|---|---|---|---|---|---|---|---|
| Steel | C | Si | Mn | P | S | Al | Cr | Cu | Nb | Mo | N | Ti |
| A | 0.20 | 0.22 | 0.90 | 0.008 | 0.005 | 0.04 | 0.49 | 0.02 | 0.015 | 0.38 | 0.0041 | 0.006 |
| B | 0.20 | 0.30 | 1.00 | 0.004 | 0.005 | 0.03 | 0.71 | 0.04 | 0.031 | 0.63 | 0.0045 | 0.007 |
| C | 0.19 | 0.29 | 0.98 | 0.003 | 0.005 | 0.10 | 0.71 | 0.03 | 0.029 | 0.63 | 0.0039 | 0.005 |
| D | 0.20 | 0.31 | 1.02 | 0.004 | 0.005 | 0.08 | 0.71 | 0.03 | 0.027 | 0.63 | 0.0051 | 0.006 |
| E | 0.24 | 0.30 | 1.00 | 0.004 | 0.006 | 0.08 | 0.69 | 0.04 | 0.024 | 0.55 | 0.0021 | 0.007 |
| F | 0.23 | 0.33 | 0.87 | 0.009 | 0.002 | 0.09 | 0.67 | 0.03 | 0.023 | 0.56 | 0.0045 | 0.008 |

| | Chemical composition [% by weight*] | | | | | | | | | |
|---|---|---|---|---|---|---|---|---|---|---|
| Steel | V | Ni | B | H [ppm] | Ca | CET [%] | Pcm [%] | Ceq [%] | Ac1 [° C.] | Ac3 [° C.] |
| A | 0.02 | 1.31 | 0.0018 | 1.9 | 0.0008 | 0.39 | 0.34 | 0.59 | 724 | 829 |
| B | 0.01 | 2.00 | 0.0004 | 1.8 | 0.0009 | 0.45 | 0.37 | 0.73 | 720 | 817 |
| C | 0.00 | 1.93 | 0.0022 | 2.0 | 0.0009 | 0.44 | 0.37 | 0.72 | 722 | 820 |
| D | 0.03 | 1.99 | 0.0024 | 2.0 | 0.0007 | 0.45 | 0.39 | 0.74 | 720 | 818 |
| E | 0.04 | 1.20 | 0.0027 | 1.9 | 0.0008 | 0.46 | 0.41 | 0.73 | 729 | 825 |
| F | 0.04 | 1.10 | 0.0023 | 2.0 | 0.0007 | 0.44 | 0.39 | 0.69 | 731 | 831 |

*Remainder iron and unavoidable impurities including inactive traces of As, Co and Sn CET: carbon equivalent according to Uwer and Höhne Pcm: carbon equivalent according to Ito & Bessyo Ceq: carbon equivalent according to Kihara Calculation of Ac1 and Ac3 each according to Hougardy A-D: comparative examples E-F: inventive examples

TABLE 2

| Steel | Sample no. | Sheet thickness [mm] | Slab thickness [mm] | Slab temperature [° C.] | Initial rolling temperature [° C.] | Final rolling temperature [° C.] | Total deformation [%] |
|---|---|---|---|---|---|---|---|
| A | A1 | 10.5 | 55 | 1200 | 1140 | 880 | 81 |
| | A2 | 10.5 | 55 | 1200 | 1140 | 880 | 81 |
| | A3 | 10.5 | 55 | 1200 | 1140 | 880 | 81 |
| | A4 | 10.5 | 55 | 1200 | 1140 | 880 | 81 |
| B | B1 | 10.1 | 55 | 1200 | 1140 | 890 | 82 |
| | B2 | 10.1 | 55 | 1200 | 1140 | 890 | 82 |
| | B3 | 10.1 | 55 | 1200 | 1140 | 890 | 82 |
| | B4 | 10.1 | 55 | 1200 | 1140 | 890 | 82 |
| C | C1 | 10.2 | 55 | 1200 | 1140 | 910 | 81 |
| | C2 | 10.2 | 55 | 1200 | 1140 | 910 | 81 |
| | C3 | 10.2 | 55 | 1200 | 1140 | 910 | 81 |
| | C4 | 10.2 | 55 | 1200 | 1140 | 910 | 81 |
| | C5 | 6.2 | 55 | 1200 | 1140 | 845 | 89 |
| | C6 | 6.2 | 55 | 1200 | 1140 | 845 | 89 |
| D | D1 | 10.1 | 55 | 1200 | 1140 | 890 | 82 |
| | D2 | 10.1 | 55 | 1200 | 1140 | 890 | 82 |
| | D3 | 10.1 | 55 | 1200 | 1140 | 890 | 82 |
| | D4 | 10.1 | 55 | 1200 | 1140 | 890 | 82 |
| E | E1 | 6.0 | 60 | 1200 | 1140 | 865 | 90 |
| | E2 | 6.0 | 60 | 1200 | 1140 | 865 | 90 |
| | E3 | 6.1 | 60 | 1200 | 1140 | 855 | 90 |
| | E4 | 6.1 | 60 | 1200 | 1140 | 855 | 90 |
| | E5 | 10.0 | 60 | 1200 | 1140 | 930 | 83 |
| | E6 | 10.0 | 60 | 1200 | 1140 | 930 | 83 |
| | E7 | 9.9 | 60 | 1200 | 1140 | 925 | 83 |
| | E8 | 9.9 | 60 | 1200 | 1140 | 925 | 83 |
| F | F1 | 10.4 | 260 | 1250 | 1119 | 919 | 96 |
| | F2 | 8.4 | 260 | 1250 | 1136 | 896 | 97 |
| | F3 | 6.4 | 260 | 1250 | 1107 | 885 | 98 |
| | F4 | 12.5 | 260 | 1250 | 1124 | 992 | 95 |
| | F5 | 6.7 | 260 | 1250 | 1110 | 882 | 97 |
| | F6 | 8.7 | 260 | 1250 | 1127 | 893 | 97 |
| | F7 | 6.6 | 260 | 1250 | 1116 | 908 | 97 |
| | F8 | 6.7 | 260 | 1250 | 1110 | 882 | 97 |
| | F9 | 8.7 | 260 | 1250 | 1127 | 893 | 97 |
| | F10 | 8.8 | 260 | 1250 | 1130 | 883 | 97 |
| | F11 | 12.5 | 260 | 1250 | 1124 | 992 | 95 |
| | F12 | 12.5 | 260 | 1250 | 1124 | 992 | 95 |
| | F13 | 6.5 | 260 | 1250 | 1116 | 908 | 98 |
| | F14 | 6.5 | 260 | 1250 | 1110 | 882 | 98 |
| | F15 | 6.5 | 260 | 1250 | 1178 | 944 | 98 |
| | F16 | 6.5 | 260 | 1250 | 1178 | 944 | 98 |
| | F17 | 6.5 | 260 | 1250 | 1174 | 952 | 98 |
| | F18 | 6.5 | 260 | 1250 | 1174 | 952 | 98 |
| | F19 | 6.5 | 260 | 1250 | 1144 | 939 | 98 |
| | F20 | 6.5 | 260 | 1250 | 1144 | 939 | 98 |
| | F21 | 6.5 | 260 | 1250 | 1142 | 931 | 98 |
| | F22 | 6.5 | 260 | 1250 | 1142 | 931 | 98 |
| | F23 | 8.5 | 260 | 1250 | 1187 | 915 | 97 |
| | F24 | 8.5 | 260 | 1250 | 1187 | 915 | 97 |
| | F25 | 8.5 | 260 | 1250 | 1191 | 913 | 97 |
| | F26 | 8.5 | 260 | 1250 | 1191 | 913 | 97 |
| | F27 | 8.5 | 260 | 1250 | 1182 | 917 | 97 |
| | F28 | 8.5 | 260 | 1250 | 1182 | 917 | 97 |
| | F29 | 8.5 | 260 | 1250 | 1196 | 923 | 97 |
| | F30 | 8.5 | 260 | 1250 | 1196 | 923 | 97 |
| | F31 | 8.5 | 260 | 1250 | 1130 | 883 | 97 |
| | F32 | 8.5 | 260 | 1250 | 1127 | 893 | 97 |
| | F33 | 11.0 | 260 | 1250 | 1127 | 893 | 96 |
| | F34 | 11.0 | 260 | 1250 | 1127 | 893 | 96 |
| | F35 | 12.5 | 260 | 1250 | 1127 | 893 | 95 |
| | F36 | 15.0 | 260 | 1250 | 1127 | 893 | 94 |
| | F37 | 15.0 | 260 | 1250 | 1127 | 893 | 94 |
| | F38 | 6.0 | 260 | 1250 | 1127 | 893 | 98 |
| | F39 | 6.0 | 260 | 1250 | 1127 | 893 | 98 |
| | F40 | 6.5 | 260 | 1250 | 1127 | 893 | 98 |
| | F41 | 7.5 | 260 | 1250 | 1127 | 893 | 97 |
| | F42 | 7.5 | 260 | 1250 | 1127 | 893 | 97 |
| | F43 | 7.5 | 260 | 1250 | 1127 | 893 | 97 |
| | F44 | 8.0 | 260 | 1250 | 1127 | 893 | 97 |
| | F45 | 8.0 | 260 | 1250 | 1127 | 893 | 97 |
| | F46 | 8.0 | 260 | 1250 | 1127 | 893 | 97 |
| | F47 | 8.0 | 260 | 1250 | 1127 | 893 | 97 |
| | F48 | 8.5 | 260 | 1250 | 1127 | 893 | 97 |

TABLE 2-continued

| Steel | Sample no. | Sheet thickness [mm] | Slab thickness [mm] | Slab temperature [° C.] | Initial rolling temperature [° C.] | Final rolling temperature [° C.] | Total deformation [%] |
|---|---|---|---|---|---|---|---|
| | F49 | 8.5 | 260 | 1250 | 1127 | 893 | 97 |
| | F50 | 8.5 | 260 | 1250 | 1124 | 992 | 97 |

TABLE 3

| | | 1st hardening | | | |
|---|---|---|---|---|---|
| Steel | Sample no. | Quench medium | Austen-itization temperature [° C.] | Mean cooling rate from 800° C. to 500° C. [K/s] | Cooling stop temperature [° C.] |
| A | A1 | Water | 920 | 98 | <200° C. |
| | A2 | | | 98 | |
| | A3 | | | 98 | |
| | A4 | | | 98 | |
| B | B1 | Water | 920 | 104 | <200° C. |
| | B2 | | | 104 | |
| | B3 | | | 104 | |
| | B4 | | | 104 | |
| C | C1 | Water | 920 | 102 | <200° C. |
| | C2 | | | 102 | |
| | C3 | | | 102 | |
| | C4 | | | 102 | |
| | C5 | | | 228 | |
| | C6 | | | 228 | |
| D | D1 | Water | 920 | 104 | <200° C. |
| | D2 | | | 104 | |
| | D3 | | | 104 | |
| | D4 | | | 104 | |
| E | E1 | Water | 920 | 237 | <200° C. |
| | E2 | | | 237 | |
| | E3 | | | 231 | |
| | E4 | | | 231 | |
| | E5 | | | 106 | |
| | E6 | | | 106 | |
| | E7 | | | 107 | |
| | E8 | | | 107 | |
| F | F1 | Water | 920 | 100 | <200° C. |
| | F2 | | | 141 | |
| | F3 | | | 215 | |
| | F4 | | | 74 | |
| | F5 | | | 202 | |
| | F6 | | | 131 | |
| | F7 | Water | 880 | 204 | <200° C. |
| | F8 | | | 202 | |
| | F9 | | | 131 | |
| | F10 | | | 130 | |
| | F11 | | | 74 | |
| | F12 | Water | 920 | 74 | <200° C. |
| | F13 | Water | 880 | 210 | <200° C. |
| | F14 | | | 210 | |
| | F15 | | | 210 | |
| | F16 | | | 210 | |
| | F17 | | | 210 | |
| | F18 | | | 210 | |
| | F19 | | | 210 | |
| | F20 | | | 210 | |
| | F21 | | | 210 | |
| | F22 | | | 210 | |
| | F23 | | | 137 | |
| | F24 | | | 137 | |
| | F25 | | | 137 | |
| | F26 | | | 137 | |
| | F27 | | | 137 | |
| | F28 | | | 137 | |
| | F29 | | | 137 | |
| | F30 | | | 137 | |
| | F31 | | | 137 | |
| | F32 | | | 137 | |
| | F33 | | | 91 | |
| | F34 | | | 91 | |

TABLE 3-continued

| | | 1st hardening | | | |
|---|---|---|---|---|---|
| Steel | Sample no. | Quench medium | Austen-itization temperature [° C.] | Mean cooling rate from 800° C. to 500° C. [K/s] | Cooling stop temperature [° C.] |
| | F35 | | | 74 | |
| | F36 | | | 55 | |
| | F37 | | | 55 | |
| | F38 | | | 239 | |
| | F39 | | | 239 | |
| | F40 | | | 210 | |
| | F41 | | | 167 | |
| | F42 | | | 167 | |
| | F43 | | | 167 | |
| | F44 | | | 151 | |
| | F45 | | | 151 | |
| | F46 | | | 151 | |
| | F47 | | | 151 | |
| | F48 | | | 137 | |
| | F49 | | | 137 | |
| | F50 | | | 137 | |

TABLE 4

| | | 2nd hardening | | | |
|---|---|---|---|---|---|
| Steel | Sample no. | Quench medium | Austen-itization temperature [° C.] | Mean cooling rate from 800° C. to 500° C. [K/s] | Cooling stop temperature [° C.] |
| A | A1 | — | — | — | — |
| | A2 | | | | |
| | A3 | | | | |
| | A4 | | | | |
| B | B1 | — | — | — | — |
| | B2 | | | | |
| | B3 | | | | |
| | B4 | | | | |
| C | C1 | — | — | — | — |
| | C2 | | | | |
| | C3 | | | | |
| | C4 | | | | |
| | C5 | | | | |
| | C6 | | | | |
| D | D1 | — | — | — | — |
| | D2 | | | | |
| | D3 | | | | |
| | D4 | | | | |
| E | E1 | — | — | — | — |
| | E2 | | | | |
| | E3 | | | | |
| | E4 | | | | |
| | E5 | | | | |
| | E6 | | | | |
| | E7 | | | | |
| | E8 | | | | |
| F | F12 | Water | 920 | 74 | <200° C. |
| | F13 | Water | 880 | 210 | <200° C. |
| | F14 | | | 210 | |
| | F15 | | | 210 | |
| | F16 | | | 210 | |

TABLE 4-continued

| Steel | Sample no. | 2nd hardening Quench medium | Austen-itization temperature [° C.] | Mean cooling rate from 800° C. to 500° C. [K/s] | Cooling stop temperature [° C.] |
|---|---|---|---|---|---|
| | F17 | | | 210 | |
| | F18 | | | 210 | |
| | F19 | | | 210 | |
| | F20 | | | 210 | |
| | F21 | | | 210 | |
| | F22 | | | 210 | |
| | F23 | | | 137 | |
| | F24 | | | 137 | |
| | F25 | | | 137 | |
| | F26 | | | 137 | |
| | F27 | | | 137 | |
| | F28 | | | 137 | |
| | F29 | | | 137 | |
| | F30 | | | 137 | |
| | F31 | | | 137 | |
| | F32 | | | 137 | |
| | F33 | | | 91 | |
| | F34 | | | 91 | |

TABLE 4-continued

| Steel | Sample no. | 2nd hardening Quench medium | Austen-itization temperature [° C.] | Mean cooling rate from 800° C. to 500° C. [K/s] | Cooling stop temperature [° C.] |
|---|---|---|---|---|---|
| | F35 | | | 74 | |
| | F36 | | | 55 | |
| | F37 | | | 55 | |
| | F38 | | | 239 | |
| | F39 | | | 239 | |
| | F40 | | | 210 | |
| | F41 | | | 167 | |
| | F42 | | | 167 | |
| | F43 | | | 167 | |
| | F44 | | | 151 | |
| | F45 | | | 151 | |
| | F46 | | | 151 | |
| | F47 | | | 151 | |
| | F48 | | | 137 | |
| | F49 | | | 137 | |
| | F50 | | | 137 | |

TABLE 5

| Steel | Sample no. | 3rd hardening Quench medium | Austenitization temperature [° C.] | Mean cooling rate from 800° C. to 500° C. [K/s] | Cooling stop temperature [° C.] | Tempering temperature [° C.] |
|---|---|---|---|---|---|---|
| A | A1 | — | — | — | — | — |
| | A2 | | | | | 225 |
| | A3 | | | | | 250 |
| | A4 | | | | | 300 |
| B | B1 | — | — | — | — | — |
| | B2 | | | | | 225 |
| | B3 | | | | | 250 |
| | B4 | | | | | 300 |
| C | C1 | — | — | — | — | — |
| | C2 | | | | | 225 |
| | C3 | | | | | 250 |
| | C4 | | | | | 300 |
| | C5 | | | | | 250 |
| | C6 | | | | | 300 |
| D | D1 | — | — | — | — | — |
| | D2 | | | | | 225 |
| | D3 | | | | | 250 |
| | D4 | | | | | 300 |
| E | E1 | — | — | — | — | — |
| | E2 | | | | | 100 |
| | E3 | | | | | 150 |
| | E4 | | | | | 250 |
| | E5 | | | | | — |
| | E6 | | | | | 100 |
| | E7 | | | | | 150 |
| | E8 | | | | | 250 |
| F | F1 | — | — | — | — | 255 |
| | F2 | | | | | 255 |
| | F3 | | | | | 255 |
| | F4 | | | | | 250 |
| | F5 | | | | | 220 |
| | F6 | | | | | 220 |
| | F7 | — | — | — | — | 255 |
| | F8 | | | | | 255 |
| | F9 | | | | | 255 |
| | F10 | | | | | 255 |
| | F11 | | | | | 250 |
| | F12 | — | — | — | — | 250 |
| | F13 | — | — | — | — | 255 |
| | F14 | | | | | 255 |
| | F15 | | | | | 255 |
| | F16 | | | | | 255 |

TABLE 5-continued

| Steel | Sample no. | 3rd hardening: Quench medium | Austenitization temperature [° C.] | Mean cooling rate from 800° C. to 500° C. [K/s] | Cooling stop temperature [° C.] | Tempering temperature [° C.] |
|---|---|---|---|---|---|---|
| | F17 | | | | | 255 |
| | F18 | | | | | 255 |
| | F19 | | | | | 255 |
| | F20 | | | | | 255 |
| | F21 | | | | | 255 |
| | F22 | | | | | 255 |
| | F23 | | | | | 255 |
| | F24 | | | | | 255 |
| | F25 | | | | | 255 |
| | F26 | | | | | 255 |
| | F27 | | | | | 255 |
| | F28 | | | | | 255 |
| | F29 | | | | | 255 |
| | F30 | | | | | 255 |
| | F31 | | | | | 255 |
| | F32 | | | | | 255 |
| | F33 | | | | | 255 |
| | F34 | | | | | 255 |
| | F35 | | | | | 250 |
| | F36 | | | | | 255 |
| | F37 | | | | | 255 |
| | F38 | Water | 880 | 239 | <200° C. | 255 |
| | F39 | | | 239 | | 255 |
| | F40 | | | 210 | | 255 |
| | F41 | | | 167 | | 255 |
| | F42 | | | 167 | | 255 |
| | F43 | | | 167 | | 255 |
| | F44 | | | 151 | | 255 |
| | F45 | | | 151 | | 255 |
| | F46 | | | 151 | | 255 |
| | F47 | | | 151 | | 255 |
| | F48 | | | 137 | | 255 |
| | F49 | | | 137 | | 255 |
| | F50 | | | 137 | | 255 |

TABLE 6 part 1

| Steel | Sample no. | Tensile test, transverse: Rp0.2 [MPa] | Rm [MPa] | A [%] | Notch impact energy, transverse: Av −60° C. [J] | Av −40° C. [J] | Av −20° C. [J] | Hardness [HB] | Austenite grain size to DIN EN ISO 643 |
|---|---|---|---|---|---|---|---|---|---|
| A | A1 | 1080 | 1492 | 6.8 | — | 33 | — | — | — |
| | A2 | 1180 | 1395 | 9.2 | — | 38 | — | — | |
| | A3 | 1200 | 1410 | 10.1 | — | 35 | — | — | |
| | A4 | 1191 | 1382 | 10.5 | — | 32 | — | — | |
| B | B1 | 1270 | 1655 | 10.8 | — | 32 | — | — | — |
| | B2 | 1282 | 1501 | 14.1 | — | 34 | — | — | |
| | B3 | 1275 | 1480 | 11.3 | — | 39 | — | — | |
| | B4 | 1231 | 1410 | 11.4 | — | 36 | — | — | |
| C | C1 | 1120 | 1505 | 4.8 | — | 37 | — | — | — |
| | C2 | 1219 | 1453 | 7.2 | — | 36 | — | — | |
| | C3 | 1095 | 1372 | 6.5 | — | 34 | — | — | |
| | C4 | 1295 | 1500 | 13.0 | — | — | — | — | |
| | C5 | 1280 | 1481 | 10.6 | — | — | — | — | |
| | C6 | 1117 | 1320 | 11.2 | — | — | — | — | |
| D | D1 | 1253 | 1615 | 9.2 | — | 34 | — | — | — |
| | D2 | 1260 | 1450 | 8.5 | — | 36 | — | — | |
| | D3 | 1181 | 1435 | 8.0 | — | 34 | — | — | |
| | D4 | 1175 | 1380 | 9.0 | — | 31 | — | — | |
| E | E1 | 1366 | 1583 | 10.4 | — | 30 | — | — | — |
| | E2 | 1407 | 1637 | 9.6 | — | 28 | — | — | |
| | E3 | 1426 | 1605 | 8.4 | — | 28 | — | — | |
| | E4 | 1410 | 1510 | 9.2 | — | 28 | — | — | |
| | E5 | 1434 | 1572 | 10.3 | — | 32 | — | — | |
| | E6 | 1432 | 1589 | 9.2 | — | 28 | — | — | |

TABLE 6-continued part 1

| Steel | Sample no. | Tensile test, transverse Rp0.2 [MPa] | Rm [MPa] | A [%] | Notch impact energy, transverse Av −60° C. [J] | Av −40° C. [J] | Av −20° C. [J] | Hardness [HB] | Austenite grain size to DIN EN ISO 643 |
|---|---|---|---|---|---|---|---|---|---|
| | E7 | 1386 | 1636 | 10.0 | — | 28 | — | — | |
| | E8 | 1414 | 1668 | 11.2 | — | 27 | — | — | |

For undersize samples, i.e. for samples which were manufactured from sheets having a thickness of less than 10 mm, the energy absorbed in the notched impact bending test was converted to full samples, i.e. to samples having a thickness of 10 mm.

TABLE 6 part 2

| Steel | Sample no. | Tensile test, transverse Rp0.2 [MPa] | Rm [MPa] | A [%] | Notch impact energy, transverse Av −60° C. [J] | Av −40° C. [J] | Av −20° C. [J] | Hardness [HB] | Austenite grain size to DIN EN ISO 643 |
|---|---|---|---|---|---|---|---|---|---|
| F | F1 | 1303 | 1484 | 8.0 | 51 | 54 | 57 | — | G-12 |
| | F2 | 1313 | 1548 | 8.0 | 50 | 53 | 60 | — | |
| | F3 | 1307 | 1577 | 8.1 | 50 | 55 | 58 | — | |
| | F4 | 1300 | 1504 | 11.0 | 28 | 37 | — | — | |
| | F5 | 1316 | 1530 | 9.7 | 56 | 67 | 76 | — | |
| | F6 | 1307 | 1483 | 10.0 | 46 | 60 | 62 | — | |
| | F7 | 1314 | 1513 | 8.7 | 51 | 68 | 72 | — | |
| | F8 | 1337 | 1509 | 8.5 | 74 | 76 | 81 | — | |
| | F9 | 1331 | 1516 | 8.5 | 63 | 69 | 75 | — | |
| | F10 | 1356 | 1526 | 9.3 | 63 | 73 | 80 | — | |
| | F11 | 1331 | 1543 | 10.7 | 30 | 34 | — | — | |
| | F12 | 1315 | 1534 | 8.1 | 47 | 54 | — | — | |
| | F13 | 1393 | 1521 | 10.5 | 62 | 70 | 74 | 512 | G-13 |
| | F14 | 1374 | 1523 | 10.2 | 66 | 69 | 76 | 502 | |
| | F15 | 1394 | 1587 | 10.6 | 60 | 67 | — | — | |
| | F16 | 1390 | 1577 | 10.8 | 62 | 71 | — | — | |
| | F17 | 1400 | 1580 | 13.0 | 56 | 63 | — | — | |
| | F18 | 1411 | 1587 | 12.4 | 64 | 73 | — | — | |
| | F19 | 1422 | 1605 | 12.2 | 63 | 70 | — | — | |
| | F20 | 1385 | 1596 | 11.2 | 57 | 62 | — | — | |
| | F21 | 1395 | 1590 | 12.4 | 58 | 69 | — | — | |
| | F22 | 1400 | 1592 | 11.0 | 62 | 66 | — | — | |
| | F23 | 1389 | 1580 | 8.7 | 57 | 64 | — | 483 | |
| | F24 | 1416 | 1599 | 10.4 | 38 | 62 | — | 487 | |
| | F25 | 1406 | 1572 | 11.9 | 51 | 56 | — | 487 | |
| | F26 | 1382 | 1570 | 10.4 | 50 | 58 | — | 490 | |
| | F27 | 1408 | 1588 | 10.9 | 56 | 63 | — | 490 | |
| | F28 | 1388 | 1568 | 10.5 | 48 | 60 | — | 476 | |
| | F29 | 1386 | 1589 | 10.4 | 48 | 55 | — | 488 | |
| | F30 | 1383 | 1580 | 12.7 | 47 | 58 | — | 488 | |
| | F31 | 1387 | 1568 | 12.0 | 58 | 69 | 78 | 497 | |
| | F32 | 1412 | 1543 | 10.4 | 49 | 65 | 79 | 512 | |
| | F33 | 1329 | 1493 | 8.7 | — | 58 | — | — | |
| | F34 | 1318 | 1504 | 8.8 | — | — | — | — | |
| | F35 | 1400 | 1561 | 12.3 | 48 | 63 | — | — | |
| | F36 | 1344 | 1573 | 9.2 | — | 44 | — | — | |
| | F37 | 1318 | 1577 | 10.0 | — | — | — | — | |
| | F38 | 1464 | 1564 | 10.0 | — | 50 | — | — | |
| | F39 | 1452 | 1565 | 8.0 | — | 55 | — | — | |
| | F40 | 1458 | 1570 | 10.0 | — | 51 | — | — | |
| | F41 | 1481 | 1577 | 10.0 | — | 52 | — | — | |
| | F42 | 1501 | 1582 | 10.0 | — | 56 | — | — | |
| | F43 | 1485 | 1579 | 10.0 | — | 57 | — | — | |
| | F44 | 1458 | 1582 | 9.0 | — | 60 | — | — | |
| | F45 | 1443 | 1573 | 11.0 | — | 53 | — | — | |
| | F46 | 1446 | 1571 | 10.0 | — | 63 | — | — | |
| | F47 | 1439 | 1570 | 10.0 | — | 56 | — | — | |
| | F48 | 1462 | 1570 | 9.0 | — | 51 | — | — | |
| | F49 | 1448 | 1562 | 9.0 | — | 51 | — | — | |
| | F50 | 1459 | 1573 | 8.0 | — | 44 | — | — | |

For undersize samples, i.e. for samples which were manufactured from sheets having a thickness of less than 10 mm, the energy absorbed in the notched impact bending test was converted to full samples, i.e. to samples having a thickness of 10 mm.

TABLE 7

| Steel | Sample no. | Heat treatment state | Microstructure [area %] | Cold forming characteristics (bending) |
|---|---|---|---|---|
| A | A1 | 1x hardened | 100% martensite | — |
| | A2 | 1x hardened + tempered | 100% tempered martensite | |
| | A3 | | | |
| | A4 | | | |
| B | B1 | 1x hardened | 100% martensite | — |
| | B2 | 1x hardened + tempered | 100% tempered martensite | |
| | B3 | | | |
| | B4 | | | |
| C | C1 | 1x hardened | 100% martensite | — |
| | C2 | 1x hardened + tempered | 100% tempered martensite | |
| | C3 | | | |
| | C4 | | | |
| | C5 | | | |
| | C6 | | | |
| D | D1 | 1x hardened | 100% martensite | — |
| | D2 | 1x hardened + tempered | 100% tempered martensite | |
| | D3 | | | |
| | D4 | | | |
| E | E1 | 1x hardened | 100% martensite | — |
| | E2 | 1x hardened + tempered | 100% tempered martensite | |
| | E3 | | | |
| | E4 | | | |
| | E5 | 1x hardened | 100% martensite | |
| | E6 | 1x hardened + tempered | 100% tempered martensite | |
| | E7 | | | |
| | E8 | | | |
| F | F1 | 1x hardened + tempered | more than 95% tempered martensite | Satisfactory |
| | F2 | | | |
| | F3 | | | |
| | F4 | | | |
| | F5 | | | |
| | F6 | | | |
| | F7 | 1x hardened + tempered | | |
| | F8 | | | |
| | F9 | | | |
| | F10 | | | |
| | F11 | | | |
| | F12 | 2x hardened + tempered | | |
| | F13 | 2x hardened + tempered | 100% tempered martensite | Good |
| | F14 | | | |
| | F15 | | | |
| | F16 | | | |
| | F17 | | | |
| | F18 | | | |
| | F19 | | | |
| | F20 | | | |
| | F21 | | | |
| | F22 | | | |
| | F23 | | | |
| | F24 | | | |
| | F25 | | | |
| | F26 | | | |
| | F27 | | | |
| | F28 | | | |
| | F29 | | | |
| | F30 | | | |
| | F31 | | | |
| | F32 | | | |
| | F33 | | | |
| | F34 | | | |
| | F35 | | | |
| | F36 | | | |
| | F37 | | | |
| | F38 | 3x hardened + tempered | | |
| | F39 | | | |
| | F40 | | | |
| | F41 | | | |
| | F42 | | | |
| | F43 | | | |
| | F44 | | | |
| | F45 | | | |
| | F46 | | | |
| | F47 | | | |
| | F48 | | | |
| | F49 | | | |
| | F50 | | | |

What is claimed is:

1. A high-strength steel comprising:

0.23% to 0.25% by weight carbon;

0.15% to 0.35% by weight silicon;

0.85% to 1.00% by weight manganese;

0.07% to 0.10% by weight aluminum;

0.65% to 0.75% by weight chromium;

0.02% to 0.03% by weight niobium;

0.55% to 0.65% by weight molybdenum;

0.035% to 0.05% by weight vanadium;

1.10% to 1.30% by weight nickel;

0.0020% to 0.0035% by weight boron; and 0.0007% to 0.0030% by weight calcium, wherein a carbon equivalent CET is greater than or equal to 0.43% by weight and less than or equal to 0.49% by weight, where the carbon equivalent CET is calculated according to the following formula:

$$CET=[C]+([Mn]+[Mo])/10+([Cr]+[Cu])/20+[Ni]/40,$$

where [C], [Mn], [Cr], [Mo], [Cu], and [Ni] are proportions by mass of the respective elements in the high-strength steel in percent by weight.

2. The high-strength steel of claim 1 further comprising iron, unavoidable impurities, and at least one of:

≤0.012% by weight phosphorus;

≤0.003% by weight sulfur;

≤0.10% by weight copper;

≤0.006% by weight nitrogen;

≤0.008% by weight titanium;

≤0.03% by weight tin;

≤2.00ppm hydrogen;

≤0.01% by weight arsenic; or

≤0.01% by weight cobalt, wherein at least one of a carbon equivalent Pcm is greater than 0.38% by weight and less than or equal to 0.44% by weight, where the carbon equivalent Pcm is calculated according to the following formula:

$$Pcm=[C]+[Si]/30+[Mn]/20+[Cu]/20+[Ni]/60+[Cr]/20+[Mo]/15+[V]/10+5[B],$$

where [C], [Si], [Mn], [Cu], [Ni], [Cr], [Mo], [V], and [B] are proportions by mass of respective elements in the high-strength steel in percent by weight; and a carbon equivalent Ceq is greater than or equal to 0.675% by weight and less than or equal to 0.78% by weight, where the carbon equivalent Ceq is calculated according to the following formula:

$$Ceq=[C]+[Si]/24+[Mn]/6+[Ni]/40+[Cr]/5+[Mo]/4+[V]/14,$$

where [C], [Si], [Mn], [Ni], [Cr], [Mo], and [V] are proportions by mass of the respective elements in the high-strength steel in percent by weight.

3. The high-strength steel of claim 1 wherein a sum total of the carbon and the manganese in the high-strength steel is in a range of 1.10% to 1.24% by weight.

4. The high-strength steel of claim 1 wherein the high-strength steel has an austenite grain size of greater than 11 according to DIN EN ISO 643.

5. The high-strength steel of claim 1 further comprising nano-carbide precipitates having a mean diameter in a range of 1 nm to 10 nm.

6. The high-strength steel of claim 1 wherein a notch impact energy Av at a testing temperature of −40° C. is at least one of greater than or equal to 30 J when a sample is aligned longitudinally with respect to a rolling direction, or greater than or equal to 27 J when the sample is aligned transverse to the rolling direction.

7. A method of manufacturing a flat steel product comprising:

producing a steel melt that includes iron, 0.23%-0.25% by weight carbon, 0.15%-0.35% by weight silicon, 0.85%-1.00% by weight manganese, 0.07%-0.10% by weight aluminum, 0.65%-0.75% by weight chromium, 0.02%-0.03% by weight niobium, 0.55%-0.65% by weight molybdenum, 0.035%-0.05% by weight vanadium, 1.10%-1.30% by weight nickel, 0.0020%-0.0035% by weight boron, 0.0007%-0.0030% by weight calcium, and at least one of ≤0.012% by weight phosphorus, ≤0.003% by weight sulfur, ≤0.10% by weight copper, ≤0.006% by weight nitrogen, ≤0.008% by weight titanium, ≤0.03% by weight tin, ≤2.00 ppm hydrogen, ≤0.01% by weight arsenic, or ≤0.01% by weight cobalt;

reducing a content of hydrogen by a vacuum treatment of the steel melt;

casting the steel melt to form a slab;

heating the slab to a temperature in a range of 1100° C. to 1250° C.;

descaling the slab;

hot rolling the slab to give a flat steel product, wherein an initial rolling temperature in the hot rolling is in a range of 1050° C. to 1250° C. and a final rolling temperature is at least 880° C., wherein a carbon equivalent CET is greater than or equal to 0.43% by weight and less than or equal to 0.49% by weight, where the carbon equivalent CET is calculated according to the following formula:

$$CET=[C]+([Mn]+[Mo])/10+([Cr]+[Cu])/20+[Ni]/40,$$

where [C], [Mn], [Cr], [Mo], [Cu], and [Ni] are proportions by mass of the respective elements in the high-strength steel in percent by weight.

8. The method of claim 7 further comprising coiling the flat steel product, wherein a coiling temperature is at least 800° C.

9. The method of claim 7 wherein a carbon equivalent Pcm is greater than 0.38% by weight and less than or equal to 0.44% by weight, wherein the carbon equivalent Pcm is calculated as $Pcm=[C]+[Si]/30+[Mn]/20+[Cu]/20+[Ni]/60+[Cr]/20+[Mo]/15+[V]/10+5[B]$, where [C], [Si], [Mn], [Cu], [Ni], [Cr], [Mo], [V], and [B] are proportions by mass of respective elements in the high-strength steel in percent by weight.

10. The method of claim 7 further comprising subjecting the flat steel product to a hardening treatment after the hot rolling while the flat steel product is still hot from the hot rolling, wherein the hardening treatment comprises quenching of the flat steel product to a temperature below 200° C. at a cooling rate of at least 25 K/s.

11. The method of claim 10 wherein the hardening treatment is a first hardening treatment, the method further comprising subjecting the flat steel product to a second hardening treatment while the flat steel product is still hot from the hot rolling, the second hardening treatment comprising:

heating the flat steel product to an austenization temperature at least 40 K above an Ac3 temperature of the flat steel product, wherein the Ac3 temperature of the flat steel product is calculated as $Ac3\ [°\ C.]=902-255*[C]+19*[Si]-11*[Mn]-5*[Cr]+13*[Mo]-20*[Ni]+55*[V]$, where [C], [Si], [Mn], [Cr], [Mo], [Ni], and [V] are proportions by mass of respective elements in the high-strength steel in percent by weight; and quenching the flat steel product to a temperature below 200° C. at a cooling rate that is at least 25 K/s.

12. The method of claim 10 wherein an austenite grain size of the flat steel product after the hardening treatment is greater than 11 according to DIN EN ISO 643.

13. The method of claim 10 further comprising tempering the flat steel product after the hardening treatment, wherein a hold time for the tempering is less than 15 minutes and a temperature for the tempering is below an Ac1 temperature of the flat steel product, wherein the Ac1 temperature is calculated as $Ac1[°\ C.]=739-22*[C]+2*[Si]-7*[Mn]+14*[Cr]+13*[Mo]-13*[Ni]+20*[V]$, where [C], [Si], [Mn], [Cr], [Mo], [Ni], and [V] are proportions by mass of respective elements in the high-strength steel in percent by weight.

14. The method of claim 7 further comprising subjecting the flat steel product to a hardening treatment after the hot rolling, wherein the hardening treatment comprises:

heating the flat steel product to an austenization temperature at least 40 K above an Ac3 temperature of the flat steel product, wherein the Ac3 temperature of the flat steel product is calculated as $Ac3[°\ C.]=902-255*[C]+19*[Si]-11*[Mn]-5*[Cr]+13*[Mo]-20[Ni]+55*[V]$, where [C], [Si], [Mn], [Cr], [Mo], [Ni], and [V] are proportions by mass of respective elements in the high-strength steel in percent by weight; and quenching the flat steel product to a temperature below 200° C. at a cooling rate that is at least 25 K/s.

15. The method of claim 14 wherein the austenization temperature is in a range of 860° C. to 920° C.

16. The method of claim 14 wherein the flat steel product is held at the austenization temperature for 60 minutes or less.

17. The method of claim 14 wherein hardening treatment is performed at least twice on the flat steel product.

18. The method of claim 7 wherein a sheet thickness of the flat steel product is in a range of 3.0 mm to 40.0 mm and a sheet width of the flat steel product is less than or equal to 3900 mm.

* * * * *